US008157367B2

(12) United States Patent
Matsuhashi

(10) Patent No.: US 8,157,367 B2
(45) Date of Patent: Apr. 17, 2012

(54) RECORDING APPARATUS AND RECORDING METHOD

(75) Inventor: Kunihiko Matsuhashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 520 days.

(21) Appl. No.: 12/358,921

(22) Filed: Jan. 23, 2009

(65) Prior Publication Data

US 2009/0189940 A1 Jul. 30, 2009

(30) Foreign Application Priority Data

Jan. 24, 2008 (JP) ..... 2008-013538
Dec. 12, 2008 (JP) ..... 2008-317574

(51) Int. Cl.
*B41J 2/01* (2006.01)
*B41J 29/38* (2006.01)
*B41J 2/205* (2006.01)

(52) U.S. Cl. ..... 347/101; 347/15; 347/16

(58) Field of Classification Search ..... 347/5, 6, 347/9, 15, 16, 21, 101
See application file for complete search history.

(56) References Cited

U.S. PATENT DOCUMENTS 6,902,249 B2 * 6/2005 Suzuki et al. ..... 347/15
7,237,861 B2 * 7/2007 Suzuki et al. ..... 347/15
7,244,021 B2 * 7/2007 Arai ..... 347/102
7,458,673 B2 * 12/2008 Hoshino ..... 347/102
7,533,982 B2 * 5/2009 Yoneyama ..... 347/102
7,735,992 B2 * 6/2010 Kumagai ..... 347/102

FOREIGN PATENT DOCUMENTS

| | | |
|---|---|---|
| JP | 10-291327 | 11/1998 |
| JP | 2003-053942 | 2/2003 |
| JP | 2004-314536 | 11/2004 |
| JP | 2007-283732 | 11/2007 |
| WO | 2004/069543 | 8/2004 |

* cited by examiner

*Primary Examiner* — Daniel Petkovsek

(74) *Attorney, Agent, or Firm* — Maschoff Gilmore & Israelsen

(57) ABSTRACT

A recording apparatus includes a moving unit that can be moved in predetermined directions including a transport direction of a recording medium, a first recording processing unit that is mounted on the moving unit and performs a first recording process in which a first process solution is used for the recording medium, a second recording processing unit that is mounted on the moving unit together with the first recording processing unit and performs a second recording process, in which a second process solution that is different from the first process solution is used, for a recording processing area of the recording medium for which the first recording process is performed by the first recording processing unit, and a control unit that controls the moving unit, the first recording processing unit, and the second recording processing unit.

8 Claims, 4 Drawing Sheets

RECORDING APPARATUS AND RECORDING METHOD

BACKGROUND

1. Technical Field

The present invention relates to a recording apparatus and a recording method capable of recording an image or the like on a recording medium transported in a predetermined direction.

2. Related Art

Generally, ink jet recording apparatuses (hereinafter, referred to as printers) have been widely known as recording apparatuses that perform a recording operation for a recording medium. For the printers, as a method for improving rub resistance of a recording face (for example, a surface) of the recording medium for which a recording process is performed and suppressing uneven luster of the recording face, technology for coating the recording face with a flat film has been proposed (see JP-A-2007-283732).

In other words, in a printer disclosed in JP-A-2007-283732, a configuration in which, after a record head performs a recording process by injecting ink onto the surface of the recording medium that is transported from the upstream side to the downstream side at a constant speed, varnish coater disposed on the downstream side of the record head in the transport direction of the recording medium coats the recording face of the recording medium in the middle of a transport process with transparent ink as a coating solution is used. However, in this printer, a configuration in which a member (varnish coater) used for coating the recording face of the recording medium is additionally disposed on the transport path of the recording medium, separately from the record head, is used. Accordingly, there is a problem that the size of the apparatus is increased in accompaniment with an increase in the number of components.

Thus, in a printer disclosed in JP-A-2003-53942, a coating solution injecting nozzle for injecting a coating solution is mounted on a record head that is configured so as to perform a recording process by injecting ink while moving along the transport direction of the recording medium. In other words, on a nozzle forming face of the record head of the printer disclosed in JP-A-2003-53942, the coating solution injecting nozzle is formed in a position located on the rear side in the movement direction of the record head at a time when ink is injected onto a recording medium, relative to an ink injecting nozzle. In addition, for each one scanning in which the record head is moved for performing a recording process for the recording medium, ink as a first process solution is injected from the ink injecting nozzle, and at the same time, an overcoat solution as a second process solution is injected from the coating solution injecting nozzle so as to follow the injection of the ink.

However, in the printer disclosed in JP-A-2003-53942, injection of the ink and injection of the overcoat solution for the recording medium are configured to be performed almost simultaneously without any step interposed therebetween. Accordingly, in a step before the ink injected onto the recording face of the recording medium penetrates into the recording medium, the overcoat solution as a second process solution and the ink as a first process solution may be mixed together on the recording face of the recording medium. Therefore, in such a case, a problem such as disturbance of a record image occurs.

On the other hand, when only the overcoat solution is injected by scanning the record head again after performing injection of only the ink by scanning the record head, the ink can be sufficiently penetrated into the recording medium until the overcoat solution is injected. However, in such a case, there is a problem that the throughput of the apparatus is decreased in accompaniment with an increase in the number of scanning operations of the record head.

Such a problem also occurs in a recording apparatus in which a plurality of recording processing units are mounted on a moving unit configured to be movable in predetermined directions including the transport direction of the recording medium, and recording processes using different types of process solutions are performed by using the recording processing units while the moving unit is moved with respect to the recording medium.

SUMMARY

An advantage of some aspects of the invention is that it provides a recording apparatus and a recording method capable of performing a plurality of recording processes of different types for a recording medium without incurring an increase in the size of the apparatus that is accompanied by an increase in the number of components and a decrease in the throughput of the apparatus that is accompanied by an increase in the process steps.

According to a first aspect of the invention, there is provided a recording apparatus including: a moving unit that can be moved in predetermined directions including a transport direction of a recording medium; a first recording processing unit that is mounted on the moving unit and performs a first recording process in which a first process solution is used for the recording medium; a second recording processing unit that is mounted on the moving unit together with the first recording processing unit and performs a second recording process, in which a second process solution that is different from the first process solution is used, for a recording processing area of the recording medium for which the first recording process is performed by the first recording processing unit; and a control unit that controls the moving unit, the first recording processing unit, and the second recording processing unit. The control unit controls the moving unit, the first recording processing unit, and the second recording processing unit such that the first recording processing unit performs the first recording process for the recording medium at a time when the moving unit is moving and the second recording processing unit performs the second recording process for the recording processing area of the recording medium transported in the transport direction at a time when the moving unit is stopped.

According to the above-described recording apparatus, all the first recording processing unit and the second recording processing unit are mounted on the moving unit. Accordingly, an additional second recording processing unit other than the moving unit does not need to be disposed in the transport path of the recording medium. The moving unit is needed to move for a case where the first recording processing unit performs the first recording process for the recording medium by using the first process solution. However, when the second recording processing unit performs the second recording process for the recording processing area of the recording medium by using the second process solution, the moving unit may be configured to stop. Accordingly, the throughput of the apparatus is improved compared to a case where, even when the second recording process is performed for the recording medium, the moving unit is moved, and at the same time, the transport of the recording medium in the transport direction is started after completion of the second recording process. When the second recording processing unit performs the second recording process for the recording processing area of the recording medium by using the second process solution, the first process solution injected to the recording processing area of the recording medium by performing the first recording process penetrates into the recording medium sufficiently. Accordingly, there is a low possibility that the first process solution and the second process solution are mixed together in the recording processing area. As a result, a plurality of recording processes of different types can be performed for the recording medium without incurring an increase of the size of the apparatus that is accompanied by an increase of the number of components and a decrease of the throughput of the entire apparatus that is accompanied by an increase in the processing steps.

In the above-described recording apparatus, the control unit may be configured to control the moving unit such that the second recording processing unit is disposed on the downstream side of the recording processing area in the transport direction of the recording medium after the first recording processing unit completes the first recording process for the recording medium.

In such a case, when the first recording process for the recording medium is completed by the first recording processing unit and the moving unit is stopped, the second recording processing unit is disposed on the downstream side of the recording processing area in the transport direction of the recording medium. In this state, by starting transport of the recording medium in the transport direction, the second recording process is started. Accordingly, a process for moving the moving unit between the first recording process and the second recording process can be omitted, and thereby the throughput of the entire apparatus for performing the recording process can be improved further.

In addition, in the above-described recording apparatus, the first recording processing unit and the second recording processing unit may be mounted on the moving unit such that the mounting position of the second recording processing unit is located on the upstream side of the mounting position of the first recording processing unit in the transport direction of the recording medium.

In such a case, after the first recording process is performed for the recording medium by the first recording processing unit with the moving unit moved in the transport direction of the recording medium, the recording medium is transported in the transport direction. In addition, at the same time, the second recording process for the recording processing area of the recording medium can be performed by the second recording processing unit. Therefore, the throughput of the entire apparatus for the recording process can be improved still further.

In addition, the above-described recording apparatus may be configured to further include a transport unit that is driven so as to transport the recording medium in the transport direction, and the control unit may drive the transport unit in a state in which the moving unit is stopped after the first recording processing unit completes the first recording process for the recording medium.

In such a case, the first recording process for the recording medium performed by the first recording processing unit with the moving unit moving and the second recording process for the recording medium performed by the second recording processing unit with the moving unit stopped can be performed in a smooth manner based on driving control for the transport unit.

In addition, in the above-described recording apparatus, in a case where the amount of the second process solution injected onto the recording processing area by the second recording processing unit for each one scanning of the moving unit in the transport direction is determined to be below a predetermined amount that is needed for coating the first process solution injected onto the recording processing area by the first recording processing unit, the control unit may be configured to control the transport unit such that the transport speed at a time when the recording medium is transported in the transport direction is lowered than that for a case where the amount of the second process solution is determined not to be below the predetermined amount.

In such a case, by reducing the transport speed of the recording medium, a time required for the moving unit to pass the recording processing area of the recording medium is lengthened. In other words, the amount of the second process solution that is injected by the second recording processing unit for the recording processing area of the recording medium for each one scanning of the moving unit in the transport direction is increased. Accordingly, the number of passes of scanning of the moving unit in the transport direction can be reduced at a time when the second recording processing unit performs the second recording process for the recording processing area of the recording medium. Therefore, the amount of the second process solution injected from the second recording processing unit can reach the predetermined amount at high efficiency, compared to a case where the number of passes of scanning of the moving unit in the transport direction is increased. As a result, the throughput of the entire apparatus for performing the recording process for the recording medium can be improved.

In addition, in the above-described recording apparatus, in a case where the amount of the second process solution injected onto the recording processing area by the second recording processing unit for each one scanning of the moving unit in the transport direction is determined to be below a predetermined amount that is needed for coating the first process solution injected onto the recording processing area by the first recording processing unit, the control unit may be configured to increase the amount of the second process solution, which is injected onto the recording processing area by the second recording processing unit, within a range not exceeding the predetermined amount so as to be larger than that for a case where the amount of the second process solution is determined not to be below the predetermined amount.

In such a case, the amount of the second process solution injected by the second recording processing unit for the recording processing area of the recording medium for each one scanning of the moving unit in the transport direction is increased. Accordingly, when the second recording processing unit performs the second recording process for the recording processing area of the recording medium, the number of passes of scanning of the moving unit in the transport direction can be reduced. As a result, the throughput of the entire apparatus for performing the recording process for the recording medium can be improved.

In addition, in the above-described recording apparatus, a heating unit that heats the recording processing area may be additionally mounted on the moving unit.

In such a case, the heating unit moves above the recording processing area of the recording medium together with the moving unit by scanning the moving unit in the transport direction. Accordingly, the second process solution injected by the second recording processing unit for the recording processing area of the recording medium can be heated so as to be dried in a speedy manner without disposing an additional member for scanning the heating unit above the recording processing area of the recording medium. Therefore, the throughput of the entire apparatus for performing the recording process for the recording medium can be improved while an increase in the size of the apparatus that is accompanied by an increase in the number of components is suppressed.

In addition, in the above-described recording apparatus, the control unit may be configured to control the heating unit so as to heat the recording processing area at the same time when the second recording processing unit injects the second process solution onto the recording processing area, for each one scanning of the moving unit in the transport direction.

In such a case, the heating unit is configured to heat and dry the second process solution injected from the second recording processing unit for the recording processing area of the recording medium for each one scanning of the moving unit in the transport direction, instantly. Accordingly, the throughput of the entire apparatus for performing the recording process for the recording medium can be improved, compared to a case where the moving unit additionally scans in the transport direction for disposing the heating unit above the recording processing area of the recording medium.

In addition, in the above-described recording apparatus, the first recording processing unit may be an ink injecting nozzle that injects ink as the first process solution onto the recording medium, and the second recording processing unit may be a coating solution injecting nozzle that injects an overcoat solution as the second process solution, which can coat the recording processing area, onto the recording processing area of the recording medium for which the ink is injected.

In such a case, after a record image or the like is formed by injecting ink for the recording processing area of the recording medium from the ink injecting nozzle, the recording processing area is coated with the overcoat solution injected from the coating solution injecting nozzle. Accordingly, the rub resistance of the recording medium can be improved, and uneven luster of the recording medium can be suppressed.

According to a second aspect of the invention, there is provided a recording method in which first and second recording processing units mounted on a moving unit that can be moved in predetermined directions including a transport direction of a recording medium individually perform recording processes for the recording medium while moving relative to the recording medium. The recording method includes: performing a first recording process, in which a first process solution is used, for the recording medium by using the first recording processing unit in the middle of movement of the moving unit; and performing a second recording process, in which a second process solution that is different from the first process solution is used, for a recording processing area of the recording medium, for which the first recording process is performed, by using the second recording processing unit while the recording medium is transported in the transport direction in a state in which the moving unit is stopped. According to the above-described method, the same advantages as those of the above-described recording apparatus can be acquired.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an ink jet printer (hereinafter, referred to as a printer) and a recording method of the printer according to embodiments of the invention, as examples of a recording apparatus and a recording method, will be described with reference to the accompanying drawings. When "a vertical direction" or "a horizontal direction" is mentioned in descriptions below, a direction denoted by an arrow shown in FIG. 1 will be used as a reference. In addition, when "a front to rear direction" is mentioned, a direction perpendicular to a paper sheet, on which FIG. 1 is shown, is represented.

Figure 1:
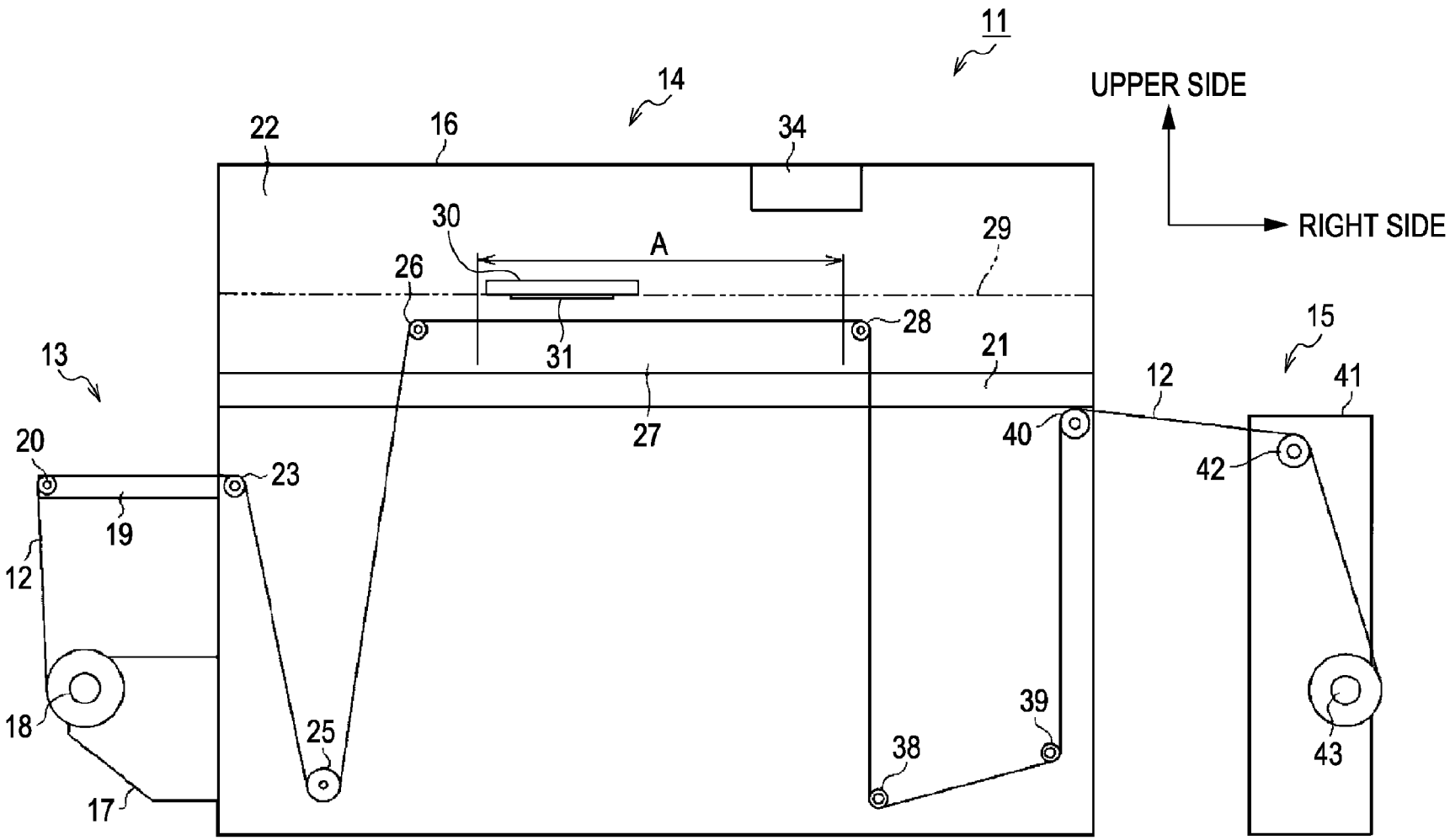
FIG. 1 is a schematic front view of an ink jet printer according to an embodiment of the invention.

As shown in FIG. 1, a printer 11 as a recording apparatus includes a feed unit 13 that continuously feeds continuous form paper 12 having a long form as a recording medium, a main body unit 14 that sequentially performs a printing process for the continuous form paper 12 fed continuously from the feed unit 13 and forms overcoat as a post process for a printing area of the continuous form paper 12, and a winding unit 15 that winds the continuous form paper 12 for which the printing process is performed and the overcoat is formed by the main body unit 14. In particular, the main body unit 14 includes a main body case 16 having a rectangular parallelepiped shape. To the left side of the main body case 16 that is the upstream side in the transport direction of the continuous form paper 12, the feed unit 13 is disposed. In addition, to the right side of the main body case 16 that is the downstream side in the transport direction of the continuous form paper 12, the winding unit 15 is disposed.

The feed unit 13 includes a support plate 17 that extends from the lower left end part of the main body case 16 to the left side. In addition, in the left end part of the support plate 17, a winding shaft 18 that extends toward the front side (the front side in the direction perpendicular to the paper sheet on which FIG. 1 is shown) is supported by the support plate 17 to be rotatable. In addition, the continuous form paper 12 that is wound in the shape of a roll in advance is supported by the winding shaft 18 to be rotatable integrally with the winding shaft 18. As the continuous form paper 12 according to this embodiment, glossy paper is used.

In addition, the feed unit 13 includes a flat plate-shaped feed board 19 that horizontally extends from the center part of the left side of the main body case 16 toward the left side. In a front end part of the feed board 19, a relay roller 20 that is used for winding the continuous form paper 12 continuously fed from the winding shaft 18 and guiding the continuous form paper 12 to the top face of the feed board 19 is installed to be rotatable. The continuous form paper 12 is transported toward the right side (the main body unit 14 side) along the top face of the feed board 19.

In a position located slightly upward from the center part in the vertical direction inside the main body case 16 of the main body unit 14, a flat plate-shaped base board 21 that vertically partitions the inside of the main body case 16 is installed. An area located upward from the base board 21 inside the main body case 16 is a printing room 22 for performing a printing process for the continuous form paper 12.

Figure 3:
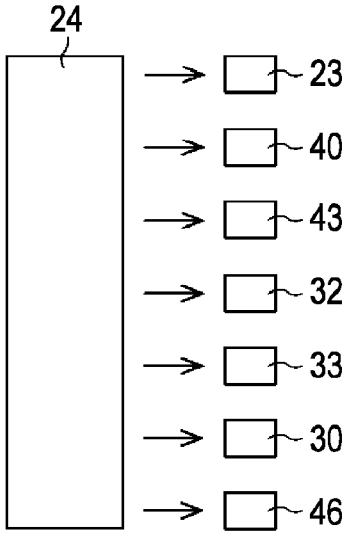
FIG. 3 is a block diagram of a control device of an ink jet printer according to an embodiment of the invention.

On the left wall of the main body case 16, a carry-in port, not shown in the figure, that is used for carrying the continuous form paper 12 in the main body case 16 from the top face of the feed board 19 is installed. In the main body unit 14, a lead-in driving roller 23 as a transport unit is installed to be rotatable, so that the lead-in driving roller 23 faces the carry-in port in a nearby position. The driving of the lead-in driving roller 23 to be rotated is controlled based on a control signal of a control device 24 (see FIG. 3) as a control unit.

To the lower right side of the lead-in driving roller 23 inside the main body case 16, a relay roller 25 is installed to be rotatable. After the continuous form paper 12 is led in the main body case 16 by driving the lead-in driving roller 23, the continuous form paper 12 is wound around the relay roller 25 from the upper left side. Then, the continuous form paper 12 is transported toward a position close to the left end part of the printing room 22.

To the upper right side of the relay roller 25 inside the printing room 22, a relay roller 26 is installed. Then, the continuous form paper 12 is wound around the relay roller 26 from the lower left side and is horizontally transported toward the right side.

In an area located to the right side of the relay roller 26 inside the printing room 22, a short plate-shaped platen 27 that is supported on the base board 21 is installed. To the right side of the platen 27, a switching roller 28 is installed so as to face the relay roller 26 with the platen 27 interposed therebetween. In this case, the top face of the relay roller 26, the top face of the platen 27, and the top face of the switching roller 28 have no level difference.

Around the switching roller 28, the continuous form paper 12 that is horizontally transported to the right side from the relay roller 26 along the top face of the platen 27 is wound from the upper left side. Then, the transport direction of the continuous form paper 12 is switched from the horizontal right side to the vertical lower side. After the transport direction of the continuous form paper 12 is switched to the vertical lower side by the switching roller 28, the continuous form paper 12 is transported to the vertical lower side through a through hole, not shown in the figure, that is installed to the base board 21.

On both front and rear sides of the platen 27 inside the printing room 22, guide rails 29 (denoted by a dashed-two dotted line in FIG. 1) that extend horizontally are installed to form a pair. In addition, the top face of the guide rail 29 is configured higher than the top face of the platen 27. On the top face of both the guide rails 29, a short plate-shaped carriage 30 as a moving unit is supported in a state in which the carriage 30 can reciprocate in the horizontal direction along both the guide rails 29. The carriage 30 is configured to horizontally move on both the guide rails 29 based on a control signal of the control device 24.

Figure 2:
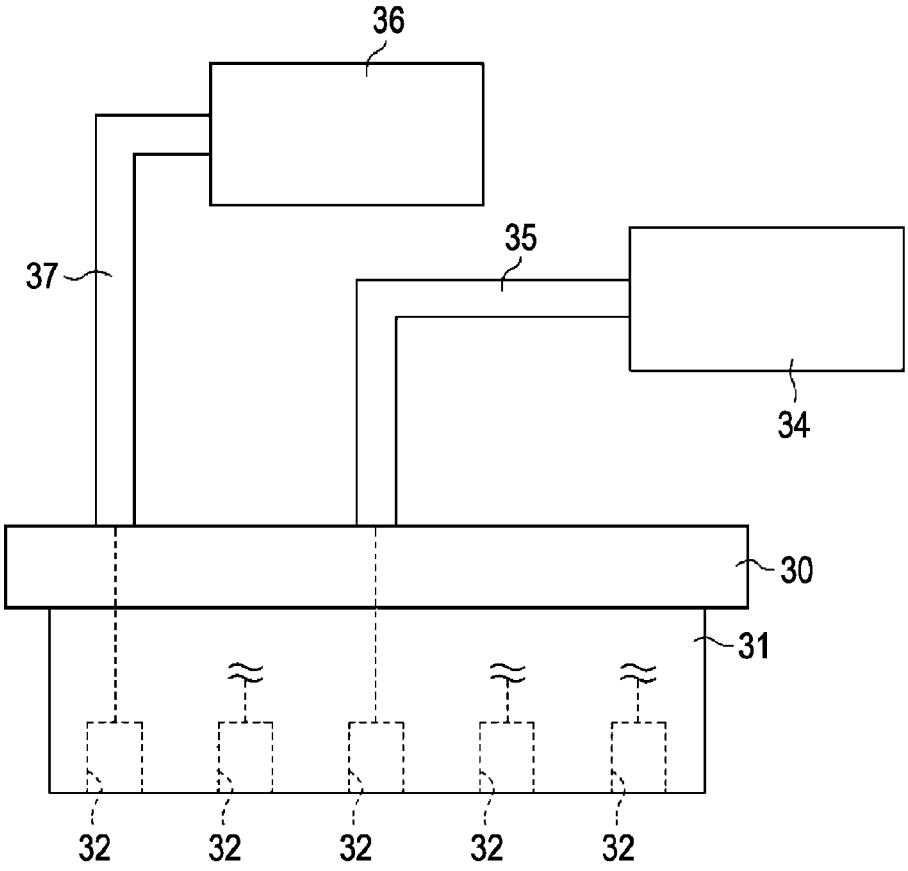
FIG. 2 is a schematic diagram of a record head of an ink jet printer according to an embodiment of the invention.

As shown in FIGS. 1 and 2, on the bottom face of the carriage 30, a record head 31 is supported. On the bottom face of the record head 31, a plurality of (four in this embodiment) ink injecting nozzles 32 as a first recording processing unit is aligned to be installed in the front to rear direction. In addition, to the left end side of the bottom face of the carriage 30 relative to the position in which the ink injecting nozzles 32 are aligned to be installed, a coating solution injecting nozzle 33 as a second recording processing unit is disposed to be parallel to the installing direction of the ink injecting nozzles 32. In other words, the coating solution injecting nozzle 33 is disposed in a position on the bottom face of the carriage 30 which is located on the upstream side of the ink injecting nozzles 32 in the transport direction of the continuous form paper 12. In addition, on the bottom face of the carriage 30, in a position located on the downstream side of the position in which the record head 31 is disposed in the transport direction of the continuous form paper 12, a heater 46 (see FIG. 4) formed of a halogen lamp or the like as a heating unit that heats the coating solution to be dried a speedy manner that is injected from the coating solution injecting nozzle 33 toward the continuous form paper 12 is disposed.

In addition, on the top wall of the main body case 16 inside the printing room 22, a valve unit 34 that is used for temporarily storing ink as a first processing solution is installed. The valve unit 34 is connected to the ink injecting nozzle 32 through an ink supplying tube 35. Although not shown in the figure, the valve units 34 and the ink supplying tubes 35 corresponding to the number of installed ink injecting nozzles 32 that are individually in correspondence with each color of ink are installed. Each valve unit 34 is connected to the ink injecting nozzle 32 through a corresponding ink supplying tube 35. Each ink injecting nozzle 32 performs a printing process as a first recording process by injecting (discharging) ink that is supplied from each valve unit 34 toward the surface of the continuous form paper 12 in a state in which the continuous form paper 12 is transported and stopped on the platen 27.

Thus, in the middle of the transport path of the continuous form paper 12, an area from the left end to the right end of the platen 27 is configured as a printing area A in which a printing process is performed for the continuous form paper 12 by injecting ink from the ink injecting nozzles 32. The continuous form paper 12 is configured to be intermittently transported along the transport path in units of an area corresponding to the printing area A.

In addition, a coating solution supplying source 36 that stores an overcoat solution therein as a second processing solution is connected to the coating solution injecting nozzle 33 through the coating solution supplying tube 37 and supplies the overcoat solution toward the coating solution injecting nozzle 33. The coating solution injecting nozzle 33 is configured to perform an overcoat (film) forming process as a second recording process for a printing face area (recording processing area) of the continuous form paper 12 by injecting the overcoat solution that is supplied from the coating solution supplying source 36 onto the printing face area of the continuous form paper 12 for which the printing process has been performed in the printing area A. In addition, injection of ink from the ink injecting nozzles 32 and injection of the overcoat solution from the coating solution injecting nozzle 33 are controlled based on a control signal of the control device 24.

As shown in FIG. 1, the continuous form paper 12 that is wound around the switching roller 28 to be transported vertically to the lower side is wound around an inversion roller 38 that is disposed in a position inside the main body case 16 which is located on the vertically lower side of the switching roller 28 to be rotatable from the upper left side and is transported to the upper right side. Then, the continuous form paper 12 that is transported from the inversion roller 38 is wound around a relay roller 39 that is installed to the right side of the inversion roller 38 inside the main body case 16 to be rotatable from the lower left side and is transported to the upper side inside the main body case 16 along the right wall of the main body case 16. In addition, the continuous form paper 12 for which the printing process has been performed in the printing area A is naturally dried in the process of transport inside the main body case 16.

In addition, in a position of the right wall of the main body case 16 near the base board 21, a carry-out port, which is not shown in the figure, used for winding the continuous form paper 12 and carrying the continuous form paper 12 out to the winding unit 15 side is installed. In a position for closely facing the carry-out port inside the main body case 16, a delivery driving roller 40 as a transport unit is installed to be rotatable. The delivery driving roller 40 is driven to rotate based on a control signal of the control device 24 and is configured to wind the continuous form paper 12 through the carry-in port and deliver the continuous form paper 12 to the winding unit 15 side.

The winding unit 15 includes a winding frame 41 having a rectangular parallelepiped shape. The height of the winding frame 41 is almost the same as that of the delivery driving roller 40. In addition, in the upper end part of the winding frame 41, a relay roller 42 is installed to be rotatable. The continuous form paper 12 that is delivered from the carry-in port is wound around the relay roller 42 from the upper left side and is transported toward the lower right side.

To the lower right side of the relay roller 42 in the winding frame 41, a winding driving shaft 43 as a transport unit that extends toward the front side is supported by the winding frame 41 to be rotatable. Around the winding driving shaft 43, the continuous form paper 12 that is transported toward the lower right side from the relay roller 42 is wound. The winding driving shaft 43 is driven to rotate based on a control signal of the control device 24 and is configured to wind the continuous form paper 12 sequentially.

Next, according to the operation of the printer 11 configured as above, a case where a printing process on the basis of injection of ink for the continuous form paper 12 and a film forming process on the basis of injecting the overcoat solution are performed will be mainly described with reference to FIGS. 4 to 7.

Figure 4:
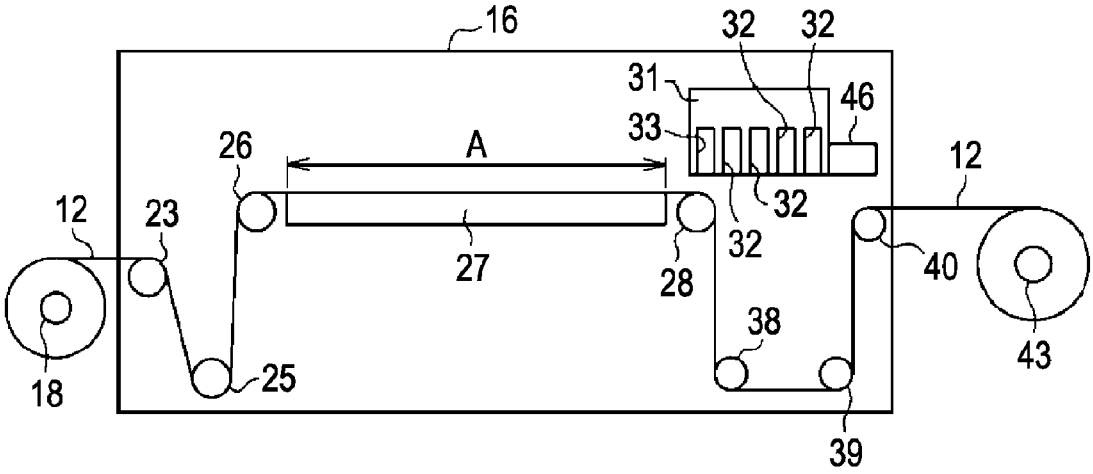
FIG. 4 is a schematic front view of the ink jet printer for a case where the record head is disposed in a home position.

When the printing process and the film forming process are performed for the continuous form paper 12, the control device 24 stops driving the lead-in driving roller 23, the delivery driving roller 40, and the winding driving shaft 43 in a previous stage. Accordingly, transport of the continuous form paper 12 from the upstream side to the downstream side is stopped in a state in which the recording processing area, for which the printing process is performed by injecting ink, is disposed inside the printing area A located on the platen 27. In the state, the carriage 30, as shown in FIG. 4, is stopped in a home position in which the record head 31 is disposed on the downstream side of the platen 27 in the transport direction of the continuous form paper 12. From the state, first, a first recording processing stage in which the printing process is performed for the continuous form paper 12 is performed. Thereafter, a second recording processing stage in which the film forming process is performed for the continuous form paper 12 is performed.

First, in the first recording processing stage, the carriage 30 moves from the home position toward the printing area A of the platen 27 and reciprocates between both left and right ends of the printing area A in the transport direction of the continuous form paper 12. Then, in the process of reciprocation of the carriage 30, ink is injected (discharged) from the ink injecting nozzle 32 toward the surface of the continuous form paper 12 that is in a state in which the recording processing area is located and stopped inside the printing area A located on the platen 27.

Figure 5:
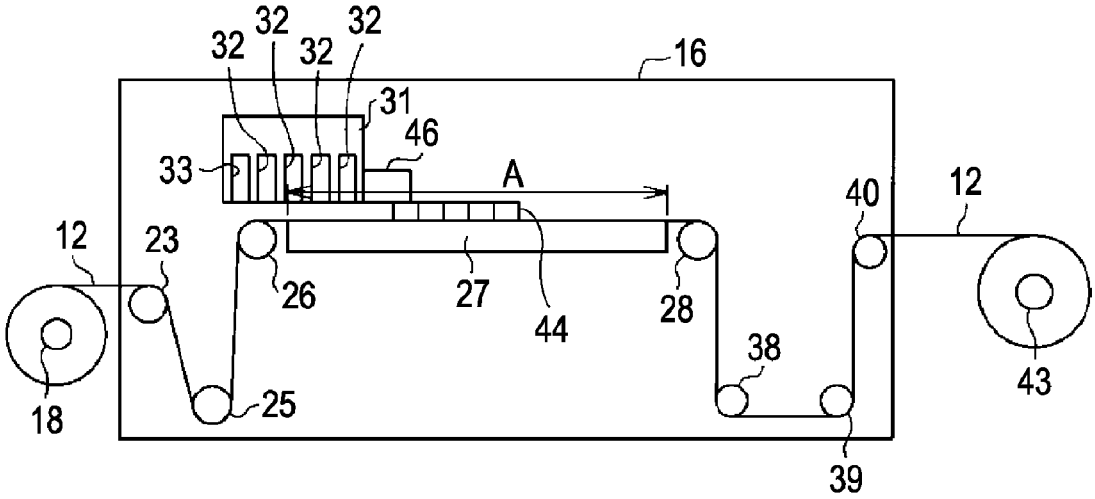
FIG. 5 is a schematic front view of the ink jet printer right after the record head performs a printing process.

Then, a print image 44 is formed in the recording processing area of the surface of the continuous form paper 12 by injecting the ink (see FIG. 5). In addition, the carriage 30 reciprocates inside the printing area A located on the platen 27 in the transport direction of the continuous form paper 12, a number of times corresponding to the number of rows (in this embodiment, four) of the plurality of the ink injecting nozzles 32 that injects ink of different colors. In each reciprocation process, from each ink injecting nozzle 32, ink of a corresponding color is injected toward the continuous form paper 12.

Figure 6:
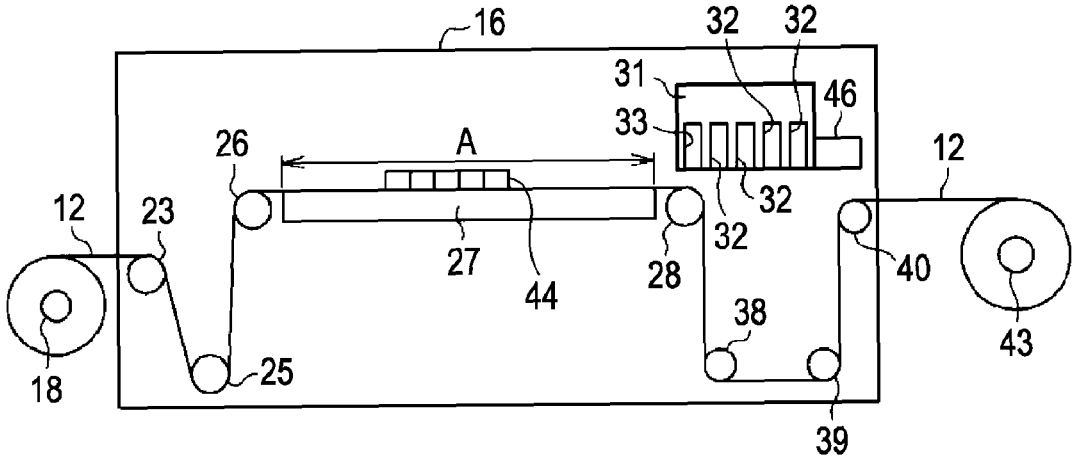
FIG. 6 is a schematic front view of the ink jet printer for a case where the record head is disposed in a position for injecting a coating solution.
Figure 7:
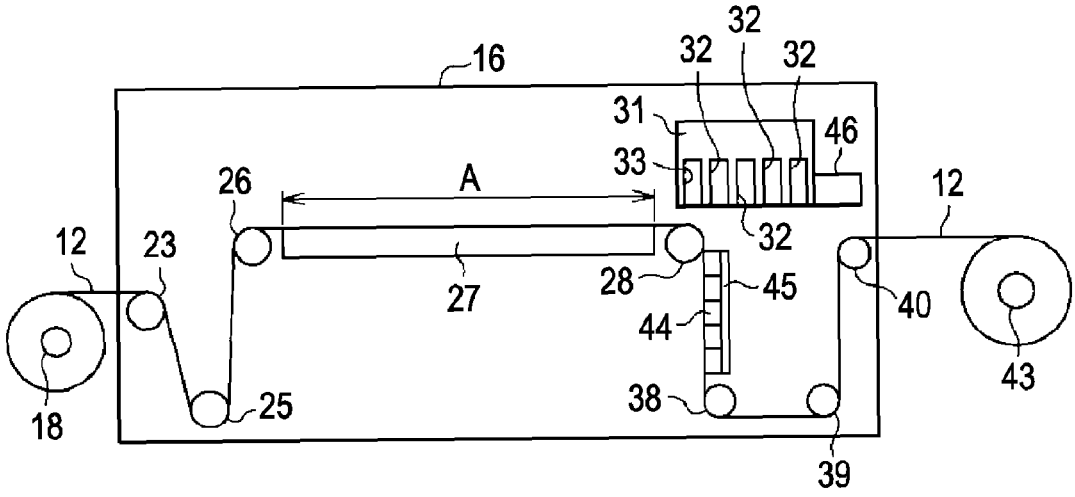
FIG. 7 is a schematic front view of the ink jet printer right after the record head performs formation of an overcoat.

Then, when a desired print image 44 is formed on the surface of the continuous form paper 12 based on injection of ink from the ink injecting nozzles 32, the carriage 30 is stopped in the home position again based on control of the control device 24 (see FIG. 6). At this moment, the coating solution injecting nozzle 33 is in a state in which the coating solution injecting nozzle 33 faces the surface of the continuous form paper 12 in a position located on the downstream end of the platen 27 in the transport direction of the continuous form paper 12.

In other words, the stop position of the carriage 30 is set such that even in a case where the continuous form paper 12 is transported to the downstream side and injection of the overcoat solution from the coating solution injecting nozzle 33 is started at the same time when the first recording processing stage is completed, the film forming process can be performed for the recording processing area for which the printing process for the continuous form paper 12 has been performed. In this point, the throughput for a case where the printing process and the film forming process are performed for the continuous form paper 12 is improved.

Then, the second recording processing stage is performed, and the lead-in driving roller 23, the delivery driving roller 40, and the winding driving shaft 43 are driven to rotate a predetermined number of times based on control of the control device 24. Then, the continuous form paper 12 is transported to the downstream side in the transport direction of the continuous form paper 12 by a distance in units of one area corresponding to the printing area A of the platen 27 and is stopped temporarily. Then, an area for which the printing process is to be performed in the first recording processing stage of the next time is transported to the printing area A located on the platen 27 and is supported.

At this moment, the overcoat solution is injected from the coating solution injecting nozzle 33 of the record head 31 to the surface (in particular, the recording processing area for which the printing process is performed) of the continuous form paper 12 in the middle of transport from the printing area A located on the platen 27 toward the downstream side. As a result, the overcoat 45 that coats the print image 44 is formed on the surface of the continuous form paper 12 (see FIG. 7).

When the overcoat solution is injected in the second recording processing stage, a certain time has elapsed from a time point when the ink is injected onto the surface of the continuous form paper 12 in the first recording processing stage. Accordingly, the ink injected onto the surface of the continuous form paper 12 has already penetrated into the continuous form paper 12 sufficiently. As a result, the overcoat solution injected onto the continuous form paper 12 in the second recording processing stage is not mixed with the ink on the surface of the continuous form paper 12. In addition, in the second recording processing stage, as the continuous form paper 12 moves to the downstream side in the transport direction in a state in which the carriage 30 does not move and is stopped in the home position, the coating solution injecting nozzle 33 and the recording processing area of the continuous form paper 12 move relatively from each other.

Accordingly, in the second recording processing stage, the throughput is improved further by the amount corresponding to a decrease in reciprocation of the carriage 30 inside the printing area A located on the platen 27. When the above-described second recording processing stage is completed, a first recording processing stage of the next time is performed. Thereafter, a second recording processing stage of the next time is performed. Thus, each recording processing stage is repeated in the same manner.

When the film forming process is performed for the continuous form paper 12, the coating solution injected from the coating solution injecting nozzle 33 during one scanning of the carriage 30 between both the left and right ends of the printing area A in the transport direction of the continuous form paper 12 may not reach a predetermined amount for which the print image 44 of the continuous form paper 12 can be completely coated. In such a case, the carriage 30 is needed to reciprocate in the transport direction of the continuous form paper 12 several times until the coating solution injected from the coating solution injecting nozzle 33 reaches the predetermined amount. However, in order to suppress a decrease in the throughput of the entire device for performing the film forming process, it is preferable that the number of times (that is, the number of passes) of reciprocation of the carriage 30 is decreased.

In this point, in the printer 11 according to this embodiment, the control device 24 determines whether the coating solution injecting nozzle 33 can coat the print image 44 of the continuous form paper 12 with the coating solution during one scanning of the carriage 30. In particular, the control device 24 estimates the injection amount of the coating solution injected from the coating solution injecting nozzle 33 for each one scanning period of the carriage 30 based on the nozzle density of the coating solution injecting nozzle 33 that is formed on the bottom face of the carriage 30. Subsequently, the control device 24 determines whether the estimated injection amount of the coating solution is below the predetermined amount needed for coating the print image 44 of the continuous form paper 12. When determining that the coating solution injecting nozzle 33 cannot coat the print image 44 formed on the continuous form paper 12 with the coating solution during one scanning of the carriage 30, the control device 24 relatively reduces the driving speeds of the lead-in driving roller 23, the delivery driving roller 40, and the winding driving shaft 43 for decreasing the transport speed at a time when the continuous form paper 12 is transported in the transport direction, compared to a case where the coating solution injecting nozzle 33 is determined to be able to coat the print image 44 with the coating solution during one scanning of the carriage 30.

Then, as the transport speed of the continuous form paper 12 is decreased, a time required for the carriage 30 to pass through the print image 44 of the continuous form paper 12 is lengthened. In other words, the amount of the coating solution injected from the coating solution injecting nozzle 33 for the print image 44 of the continuous form paper 12 during one scanning of the carriage 30 is increased. As a result, when the coating solution injecting nozzle 33 performs the film forming process for the print image 44 of the continuous form paper 12, the number of passes for scanning of the carriage 30 in the transport direction of the continuous form paper 12 can be decreased.

At the same time, in the printer 11 according to this embodiment, when determining that the coating solution injecting nozzle 33 cannot coat the print image 44 of the continuous form paper 12 with the coating solution during one scanning of the carriage 30, the control device 24 increases the amount of coating solution per unit time which is injected from the coating solution injecting nozzle 33. In particular, when it is assumed that the number of passes of the carriage 30 that is needed for coating the print image 44 of the continuous form paper 12 is eight for a case where one dot of the coating solution injected from the coating solution injecting nozzle 33 is 7 ng, the control device 24 increases one dot of the coating solution injected from the coating solution injecting nozzle 33 to 14 ng. Then, the number of passes of the carriage 30 for performing the film forming process for the print image 44 of the continuous form paper 12 by using the coating solution injected from the coating solution injecting nozzle 33 can be decreased by half to four.

In other words, the control device 24 increases the amount of the coating solution injected from the coating solution injecting nozzle 33 for the print image 44 of the continuous form paper 12 during one scanning of the carriage 30 within the range in which the amount of the coating solution does not exceed the predetermined amount needed for coating the print image 44 of the continuous form paper 12. As a result, the number of passes of the carriage 30 for a case where the coating solution injecting nozzle 33 performs the film forming process for the print image 44 of the continuous form paper 12 can be decreased further.

When the amount of the coating solution injected from the coating solution injecting nozzle 33 for the print image 44 of the continuous form paper 12 is increased, a time required for sufficiently fixing the coating solution for the continuous form paper 12 is lengthened. Thus, when the continuous form paper 12 is transported toward the downstream side of the transport direction from the printing area A located on the platen 27 right after the coating solution is injected from the coating solution injecting nozzle 33, the coating solution falls downward vertically on the continuous form paper 12 due to the gravity. As a result, there is a problem that sufficient overcoat 45 may not be formed on the print image 44 of the continuous form paper 12.

In this point, according to the printer 11 of this embodiment, the heater 46 mounted on the carriage 30 heats the coating solution that is injected from the coating solution injecting nozzle 33 during a process in which the heater 46 passes the print image 44 of the continuous form paper 12 together with the carriage 30. Thus, even when the amount of the coating solution that is injected from the coating solution injecting nozzle 33 for the print image 44 of the continuous form paper 12 increases, the coating solution can be assuredly fixed on the continuous form paper 12 in a short time.

In addition, the control device 24 performs an operation for injecting the coating solution for the continuous form paper 12 by using the coating solution injecting nozzle 33 and an operation for heating and fixing the coating solution injected from the coating solution injecting nozzle 33 by using the heater 46 in a parallel manner during one scanning of the carriage 30. Accordingly, the carriage 30 does not need to scan additionally in the transport direction of the continuous form paper 12 for disposing the heater 46 on the print image 44 of the continuous form paper 12. As a result, a decrease in the throughput of the entire apparatus for performing the printing process for the continuous form paper 12 due to heating and fixing the coating solution injected for the continuous form paper 12 by using the heater 46 scarcely occurs.

According to this embodiment, the following advantages can be acquired.

In the above-described embodiment, all the ink injecting nozzles 32 and the coating solution injecting nozzle 33 are mounted on the carriage 30. Accordingly, an additional mechanism for forming the overcoat other than the carriage 30 does not need to be disposed in the transport path of the continuous form paper 12. The carriage 30 is needed to move for a case where the ink injecting nozzles 32 perform the printing process for a recording medium by using ink. However, when the coating solution injecting nozzle 33 performs the film forming process for the recording processing area of the continuous form paper 12 by using the overcoat solution, the carriage 30 may be configured to stop. Accordingly, the throughput of the apparatus is improved compared to a case where, even when the film forming process is performed for the continuous form paper 12, transport of the continuous form paper 12 in the transport direction is started after performing the film forming process with the carriage 30 reciprocating. When the coating solution injecting nozzle 33 performs the film forming process for the recording processing area of the continuous form paper 12 by using the overcoat solution, the ink injected to the recording processing area of the continuous form paper 12 by performing the printing process penetrates into the continuous form paper 12 sufficiently. Accordingly, there is a low possibility that the ink and the overcoat solution are mixed together in the recording processing area. As a result, a plurality of recording processes of different types can be performed for the continuous form paper 12 without incurring an increase of the size of the apparatus that is accompanied by an increase of the number of components and a decrease of the throughput of the apparatus that is accompanied by an increase in the processing steps.

In the above-described embodiment, at a time point when the printing process for the continuous form paper 12 by using the ink injecting nozzle 32 is completed and the carriage 30 is stopped, the coating solution injecting nozzle 33 is disposed on the downstream side of the recording processing area in the transport direction of the continuous form paper 12. Then, in the state, as transport of the continuous form paper 12 in the transport direction is started, the film forming process is started. Accordingly, a process for moving the carriage 30 between the printing process and the film forming process can be omitted, and thereby the throughput of the apparatus for performing the recording process can be improved further.

In the above-described embodiment, after the printing process is performed for the continuous form paper 12 by the ink injecting nozzles 32 with the record head 31 moved in the transport direction of the continuous form paper 12, the continuous form paper 12 is transported in the transport direction. In addition, at the same time, the film forming process for the recording processing area of the continuous form paper 12 is performed by the coating solution injecting nozzle 33. Therefore, the throughput of the apparatus for the recording process can be improved still further.

In the above-described embodiment, the control device 24 drives the lead-in driving roller 23, the delivery driving roller 40, and the winding driving shaft 43 as transport units for transporting the continuous form paper 12 along the transport path in a state in which the carriage 30 is stopped after the printing process for the continuous form paper 12 is completed by the ink injecting nozzle 32. Accordingly, the printing process that is performed for the continuous form paper 12 by the ink injecting nozzles 32 with the carriage 30 moving and the film forming process that is performed for the continuous form paper 12 by the coating solution injecting nozzle 33 in a state in which the carriage 30 is stopped can be performed smoothly based on control of driving the lead-in driving roller 23, the delivery driving roller 40, and the winding driving shaft 43.

In the above-described embodiment, after the print image 44 is formed by injecting ink for the recording processing area of the continuous form paper 12 from the ink injecting nozzles 32, the print image 44 is coated with the overcoat solution injected from the coating solution injecting nozzle 33. Accordingly, the rub resistance of the continuous form paper 12 can be improved, and uneven luster of the continuous form paper 12 can be suppressed.

In the above-described embodiment, by reducing the transport speed of the continuous form paper 12, a time required for the carriage 30 to pass the print image 44 of the continuous form paper 12 is lengthened. In other words, the amount of the coating solution that is injected from the coating solution injecting nozzle 33 for the print image 44 of the continuous form paper 12 for each one scanning of the carriage 30 in the transport direction is increased. Accordingly, the number of passes of scanning of the carriage 30 in the transport direction can be reduced at a time when the coating solution injecting nozzle 33 performs the film forming process for the print image 44 of the continuous form paper 12. Therefore, the amount of the coating solution injected from the coating solution injecting nozzle 33 can reach the predetermined amount for which the print image 44 of the continuous form paper 12 can be completely coated at high efficiency, compared to a case where the number of passes of scanning of the carriage 30 in the transport direction is increased. As a result, the throughput of the entire apparatus for performing the printing process for the continuous form paper 12 can be improved.

In the above-described embodiment, by increasing the amount of the coating solution injected from the coating solution injecting nozzle 33 per unit time, the amount of the coating solution injected from the coating solution injecting nozzle 33 for the print image 44 of the continuous form paper 12 for each one scanning of the carriage 30 in the transport direction is increased. Accordingly, when the coating solution injecting nozzle 33 performs the film forming process for the print image 44 of the continuous form paper 12, the number of passes of scanning of the carriage 30 in the transport direction can be reduced. As a result, the throughput of the entire apparatus for performing the printing process for the continuous form paper 12 can be improved.

In the above-described embodiment, the heater 46 moves above the print image 44 of the continuous form paper 12 together with the carriage 30 by scanning the carriage 30 in the transport direction. Accordingly, the coating solution injected from the coating solution injecting nozzle 33 for the print image 44 of the continuous form paper 12 can be heated so as to be dried in a speedy manner by using the heater 46 without disposing an additional member for scanning the heater 46 above the print image 44 of the continuous form paper 12. Therefore, the throughput of the entire apparatus for performing the printing process for the continuous form paper 12 can be improved while an increase in the size of the apparatus that is accompanied by an increase in the number of components is suppressed.

In the above-described embodiment, the heater 46 is configured to heat and dry the coating solution injected from the coating solution injecting nozzle 33 for the print image 44 of the continuous form paper 12 for each one scanning of the carriage 30 in the transport direction, instantly. Accordingly, the throughput of the entire apparatus for performing the printing process for the continuous form paper 12 can be improved compared to a case where the carriage 30 additionally scans in the transport direction for disposing the heater 46 above the print image 44 of the continuous form paper 12.

In addition, the above-described embodiment may be changed as follows.

In the above-described embodiment, the transport unit that intermittently transports the continuous form paper 12 may be installed as an external device that is configured separately from the printer 11. In such a case, the control device 24 needs to control the operations of the ink injecting nozzles 32 and the coating solution injecting nozzle 33 such that the printing process is performed at a time when the transport of the continuous form paper 12 is stopped by the transport unit, and the film forming process is performed at a time when the continuous form paper 12 is transported by the transport unit.

In addition, in the above-described embodiment, in the record head 31, the coating solution injecting nozzle 33 may be disposed in a position located on the downstream side of the ink injecting nozzles 32 in the transport direction of the continuous form paper 12.

In addition, in the above-described embodiment, the control device 24 may be configured to control the operation of the carriage 30 such that the coating solution injecting nozzle 33 is disposed on the upstream side of the recording processing area in the transport direction of the continuous form paper 12 at a time point when the printing process using the ink injecting nozzles 32 for the continuous form paper 12 is completed.

In addition, in the above-described embodiment, instead of performing the printing process at a time when transport of the continuous form paper 12 is stopped, the printing process may be configured to be performed in parallel with transport of the continuous paper sheet 12. In such a case, for example, the control device 24 may be configured to control the transport speed of the continuous form paper 12 at multiple levels, and the printing process for the continuous form paper 12 may be configured to be performed only under a condition that the transport speed is low.

In the above-described embodiment, the moving direction of the carriage 30 is not limited to the transport direction of the continuous form paper 12. For example, in a case where a maintenance unit for performing maintenance such as cleaning of the record head is disposed on both front and rear sides of the platen, the carriage 30 may be configured to be movable in the front-to-rear and rear-to-front directions that are perpendicular to the transport direction of the continuous form paper 12, as is necessary.

In addition, in the above-described embodiment, the recording process for the continuous form paper 12 is not limited to a recording process using the ink and the overcoat solution. For example, a configuration in which recording processes using a plurality of types of ink are performed for the recording processing area of the continuous form paper 12 in a superposing manner may be used. In such a case, it is preferable that an operation is performed in a state in which transport of the continuous form paper 12 is stopped for a case where a recording process requiring high precision of positions is performed and an operation is performed in parallel with transport of the continuous form paper 12 for a case where a recording process not requiring high precision of positions is performed.

In addition, in the above-described embodiment, as the recording medium, a material such as a long resin film other than the continuous form paper 12 may be used.

In the above-described embodiment, the "transport direction" is not limited to a linear direction from the upstream side toward the downstream side, and the "transport direction" is defined based on a path in which the recording medium is transported. For example, in a case where a recording medium carried in the recording area from the upstream side is discharged in a direction perpendicular to the carry-in direction, a transport path forming a bending shape is defined as the transport direction of the recording medium. In addition, the "upstream side" and the "downstream side" in the transport direction are not uniquely defined and are defined in correspondence with the transport direction of the recording medium in each stage. For example, in a case where a recording medium carried in the recording area is discharged toward the carry-in port side, an area defined as the "upstream side" in the carry-in stage is defined as the "downstream side" in the discharge stage.

In addition, in the above-described embodiment, the recording apparatus is not limited to the ink jet printer 11. For example, the invention may be applied to other types of printers such as a thermal-transfer printer, a TA (thermo autochrome) printer, and a laser printer.

What is claimed is:

1. A recording apparatus comprising:

a moving unit that can be moved in predetermined directions including a transport direction of a recording medium;

a transport unit that is driven so as to transport the recording medium in the transport direction;

a first recording processing unit that is mounted on the moving unit and performs a first recording process in which a first process solution is used for the recording medium;

a second recording processing unit that is mounted on the moving unit together with the first recording processing unit and performs a second recording process, in which a second process solution that is different from the first process solution is used, for a recording processing area of the recording medium for which the first recording process is performed by the first recording processing unit;

a heating unit that heats the recording processing area additionally mounted on the moving unit; and a control unit that controls the moving unit, the first recording processing unit, and the second recording processing unit, wherein the control unit controls the moving unit, the first recording processing unit, and the second recording processing unit such that the first recording processing unit performs the first recording process for the recording medium at a time when the moving unit is moving and the second recording processing unit performs the second recording process for the recording processing area of the recording medium transported in the transport direction at a time when the moving unit is stopped.

2. The recording apparatus according to claim 1, wherein the control unit controls the moving unit such that the second recording processing unit is disposed on the downstream side of the recording processing area in the transport direction of the recording medium after the first recording processing unit completes the first recording process for the recording medium.

3. The recording apparatus according to claim 1, wherein the first recording processing unit and the second recording processing unit are mounted on the moving unit such that the mounting position of the second recording processing unit is located on the upstream side of the mounting position of the first recording processing unit in the transport direction of the recording medium.

4. The recording apparatus according to claim 1, wherein the control unit drives the transport unit in a state in which the moving unit is stopped after the first recording processing unit completes the first recording process for the recording medium.

5. The recording apparatus according to claim 4, wherein, in a case where the amount of the second process solution injected onto the recording processing area by the second recording processing unit for each one scanning of the moving unit in the transport direction is determined to be below a predetermined amount that is needed for coating the first process solution injected onto the recording processing area by the first recording processing unit, the control unit controls the transport unit such that the transport speed at a time when the recording medium is transported in the transport direction is lowered than that for a case where the amount of the second process solution is determined not to be below the predetermined amount.

6. The recording apparatus according to claim 1, wherein, in a case where the amount of the second process solution injected onto the recording processing area by the second recording processing unit for each one scanning of the moving unit in the transport direction is determined to be below a predetermined amount that is needed for coating the first process solution injected onto the recording processing area by the first recording processing unit, the control unit increases the amount of the second process solution, which is injected onto the recording processing area by the second recording processing unit, within a range not exceeding the predetermined amount so as to be larger than that for a case where the amount of the second process solution is determined not to be below the predetermined amount.

7. The recording apparatus according to claim 1, wherein the control unit controls the heating unit so as to heat the recording processing area at the same time when the second recording processing unit injects the second process solution onto the recording processing area, for each one scanning of the moving unit in the transport direction.

8. The recording apparatus according to claim 1, wherein the first recording processing unit is an ink injecting nozzle that injects ink as the first process solution onto the recording medium, and the second recording processing unit is a coating solution injecting nozzle that injects an overcoat solution as the second process solution, which can coat the recording processing area, onto the recording processing area of the recording medium for which the ink is injected.

* * * * *